US005975075A

United States Patent [19]

Ide

[11] Patent Number: 5,975,075

[45] Date of Patent: Nov. 2, 1999

[54] EXHAUSTER FOR COOKING

[75] Inventor: Nariaki Ide, Fukuoka, Japan

[73] Assignee: Haiki Co., Ltd., Fukuoka, Japan

[21] Appl. No.: 09/088,900

[22] Filed: Jun. 2, 1998

[30] Foreign Application Priority Data

Oct. 7, 1997 [JP] Japan ..... 9-274217

[51] Int. Cl.[6] ..... F24C 15/20

[52] U.S. Cl. ..... 126/299 D; 126/299 E

[58] Field of Search ..... 126/299 D, 299 E, 126/301, 299 R

[56] References Cited

U.S. PATENT DOCUMENTS

| | | | |
|---|---|---|---|
| 4,259,945 | 4/1981 | Lawson | 126/299 E |
| 4,766,880 | 8/1988 | Blanquet | 126/299 D |
| 4,889,104 | 12/1989 | Gostelow | 126/299 R |
| 4,899,028 | 2/1990 | Arai et al. | 126/299 D |
| 5,231,972 | 8/1993 | Galassi | 126/299 R |

FOREIGN PATENT DOCUMENTS

| | | | |
|---|---|---|---|
| 55-661 | 1/1980 | Japan | 126/299 R |
| 4-309733 | 11/1992 | Japan | 126/299 D |

*Primary Examiner*—Carroll Dority
*Attorney, Agent, or Firm*—Wenderoth, Lind & Ponack, L.L.P.

[57] ABSTRACT

An exhauster for cooking includes a cooking smoke suction port disposed at the rear of a gas range on a cooking table, a vertical downward pipe with one end thereof connected to the suction port, an empty box connected to the other end of the downward pipe, the empty box having a cross-sectional area larger than that of the downward pipe, and a sirocco fan connected to the empty box, the exhaust port of the sirocco fan communicating with the outdoors.

50 Claims, 5 Drawing Sheets

EXHAUSTER FOR COOKING

BACKGROUND OF THE INVENTION

1. Field of the Invention

The present invention relates to an exhauster for cooking.

2. Description of the Related Art

A conventional exhauster for cooking comprises a suction hood provided above a gas range and having a suction port with the same width as that of the gas range, and a duct having a rectangular longitudinal cross-section connected to the suction hood, the duct elongating outside an outdoor wall with a propeller fan provided thereat. Since the suction hood has a pyramid shape extending toward the gas range provided below, the suction force from the suction port above the gas range cannot be sufficient unless the exhaust capacity of a fan is large enough so that an exhaust guiding plate is required above the gas range. Therefore, a problem is involved in that the noise of the fan is large and the structure of the exhauster is complicated.

SUMMARY OF THE INVENTION

An exhauster for cooking according to the present invention comprises a cooking smoke suction port disposed at the rear of a gas range on a cooking table, a vertical downward pipe with one end thereof connected to the suction port, an empty box connected to the other end of the downward pipe, the empty box having a cross-sectional area larger than that of the downward pipe, and a sirocco fan connected to the empty box, the exhaust port of the sirocco fan communicating with the outdoors.

DESCRIPTION OF THE PREFERRED EMBODIMENTS

Figure 1:
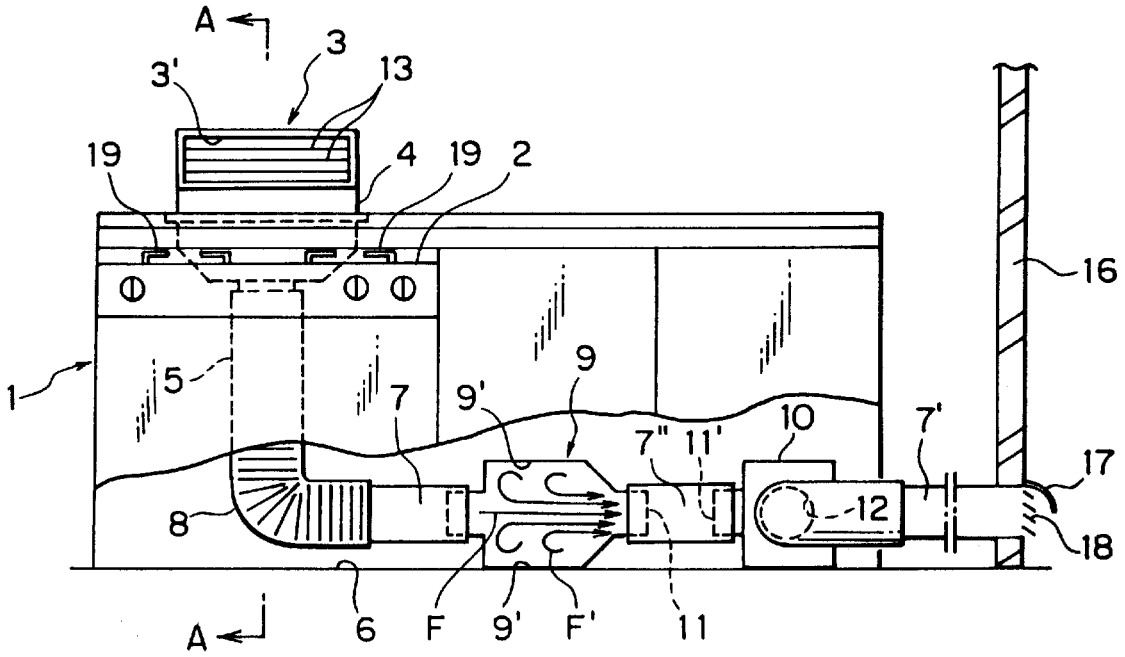
FIG. 1 is a partially-cutaway plan view showing an exhauster for cooking according to a first embodiment.
Figure 2:
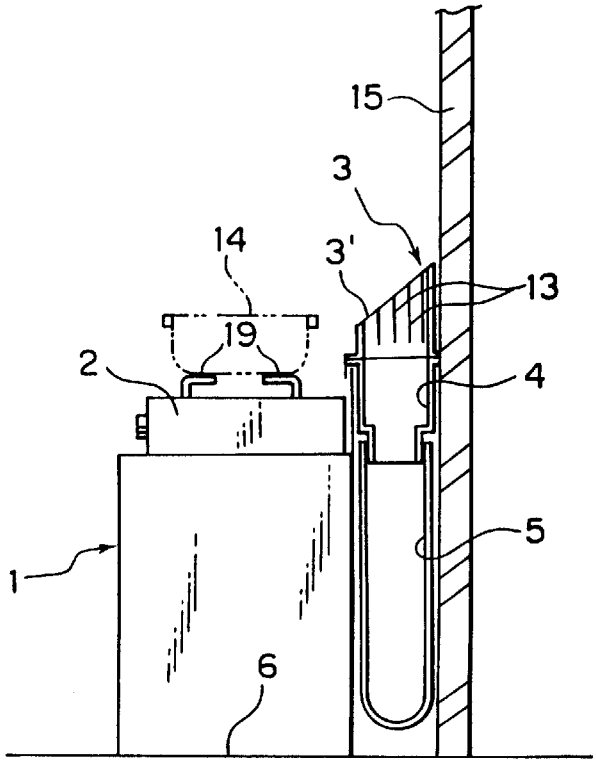
FIG. 2 is a cross-sectional view taken along the line A—A of FIG. 1.

First Embodiment:

As shown in FIGS. 1 and 2, a cooking table 1 is dosposed along a partition wall 15 of a kitchen with a gas range 2 disposed on the cooking table 1. An opening 3' of a suction port 3 is formed between the rear part of the gas range 2 and the partition wall 15 and has an inclination, facing to the space above the gas range 2. The suction port 3, accommodating a plurality of vertical heat conductive plates 13 parallel to each other, has a substantially half width with respect to the gas range 2. A downward suction box 4 is connected to the lower part of the suction port 3 with a vertical downward pipe 5 connected to the lower end of the downward suction box 4. One end of a horizontal pipe 7 is connected along floor surface 6 to the lower end of the downward pipe 5 via a bellows curved pipe 8. Connected to the other end of the horizontal pipe 7 is one end of an empty box 9 having a cross-sectional area larger than that of the pipe 7. The other end 11 of the empty box 9 is connected to a suction port 11' of a sirocco fan 10 via a pipe 7" having the same diameter size as the horizontal pipe 7. An exhaust port 12 of the sirocco fan 10 is connected with a pipe 7' having the same diameter as the horizontal pipe 7. The pipe 7' is elongated outside the outdoor wall 16, with a drip board 17 and a wind direction plate 18 provided thereat.

When the sirocco fan 10 is started in operation, the air inside the empty box 9 is drawn out, and further, the air above the gas range 2 is drawn from the suction port 3 via the horizontal pipe 7, the downward pipe 5 and the downward suction box 4. That is, vapor generated from a pot 14 placed on a grate 19 of the gas range 2 and a combustion gas generated from the gas range 2, and the like, are drawn through the opening 3' of the suction port 3 so as to be discharged outdoors from the exhaust port 12 of the sirocco fan 10 via the pipe 7'.

At the time, the inside of the empty box 9 is attracted by the passing air flow F from the pipe 7 so as to join the air F' inside an expanding diameter part 9' of the empty box 9 so that the inside of the empty box 9 has a negative pressure due to the suction force by the sirocco fan 10. Accordingly, the suction force inside the horizontal pipe 7 and the downward pipe 5 is reinforced. Further, since the suction port 3 has a substantially half width with respect to the gas range 2 and is divided by the plurality of the heat conductive plates 13, the air can be divided and drawn from the opening 3' neatly without generating a vortex. Therefore, the suction resistance can be small so that suction of cooking smoke can be facilitated. Hence, a good exhaust characteristic can be obtained even with a sirocco fan 10 having a small exhaust capacity so that a safe and quiet exhauster can be realized.

If edible oil in the pot 14 on the gas range 2 catches fire, the flame is drawn into the suction port 3 and the combustion heat is transmitted to the plurality of heat conductive plates 13 to lower the temperature thereof and extinguish the fire.

Figure 3:
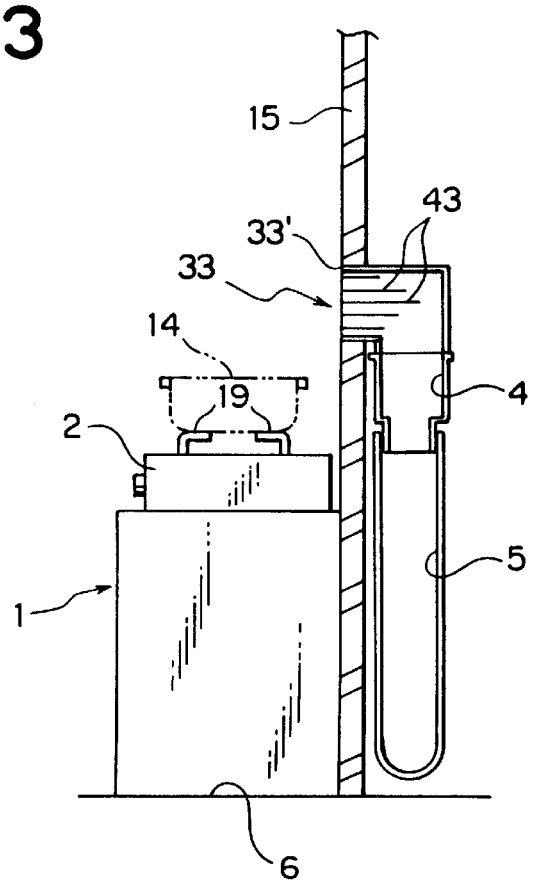
FIG. 3 is a side cross-sectional view showing an exhauster for cooking according to a second embodiment.

Second Embodiment:

As shown in FIG. 3, a suction port 33 may be disposed inside the partition wall 15 with an opening 33' formed on the surface of the partition wall 15 facing horizontally. A plurality of heat conductive plates 43 are installed horizontally and parallel to each other in the suction port 33. The downward suction box 4 and the downward pipe 5, and the like, are disposed inside the partition wall 15.

Figure 4:
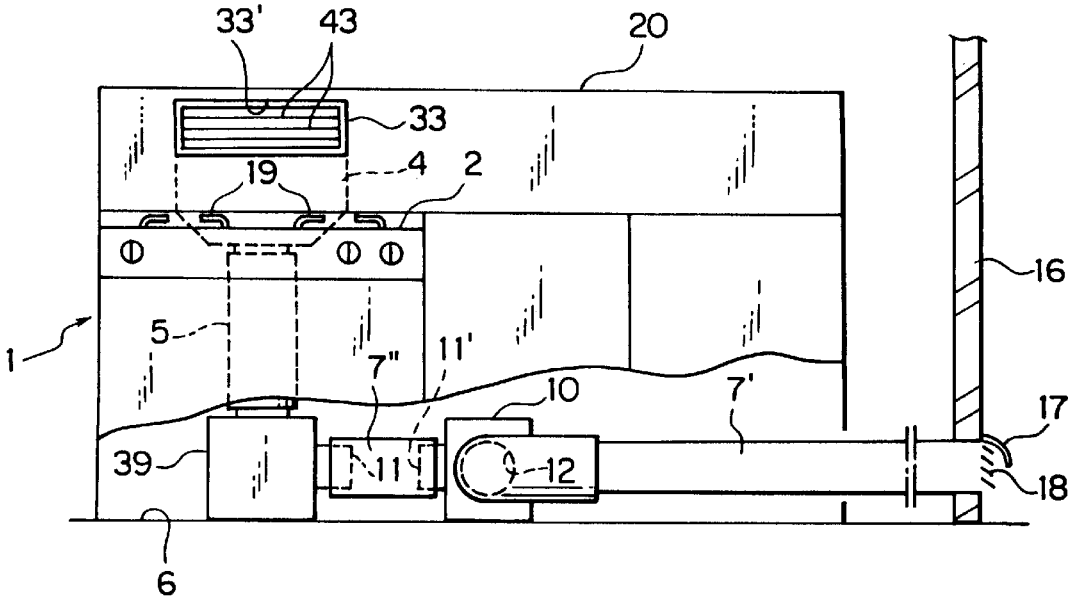
FIGS. 4 and 5 are a partially-cutaway plan view and a side cross-sectional view showing an exhauster for cooking according to a third embodiment, respectively.
Figure 5:
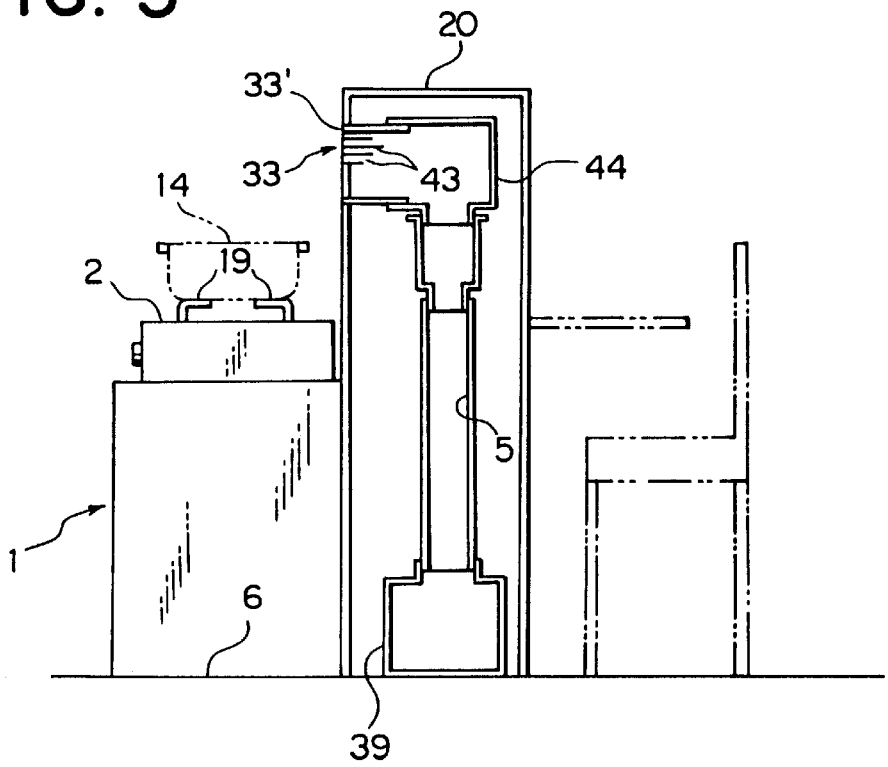
Figure 6:
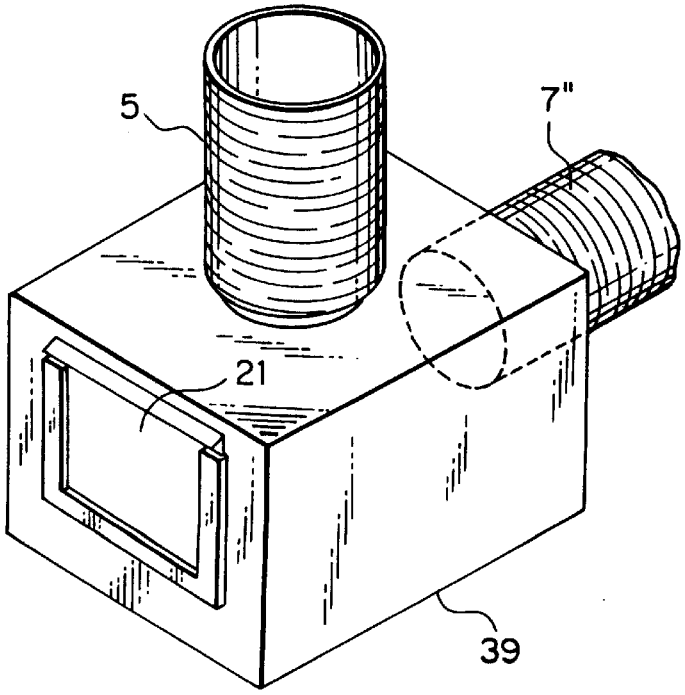
FIG. 6 is a perspective view showing an empty box used in the third embodiment.

Third Embodiment:

As shown in FIGS. 4 and 5, the suction port 33 used in the second embodiment may be disposed inside a counter 20 with opening 33' formed on the front wall of the counter 20. In the counter 20, the suction port 33 is connected to the downward pipe 5 via a downward suction box 44, and an empty box 39 is directly connected to the lower end of the downward pipe 5. The sirocco fan 10 is connected to the empty box 39 via the pipe 7". As shown in FIG. 6, the empty box 39 is provided with a door 21, which can either be open or closed, for removing oil. By opening door 21, the oil accumulated in the bottom portion of the empty box 39 can be taken out.

Figure 7A:
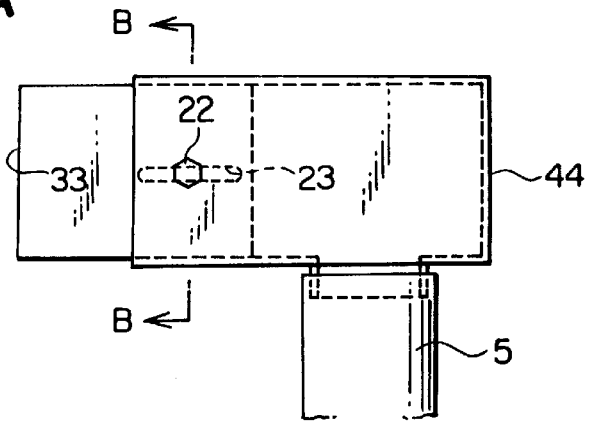
FIGS. 7A and 7B are a side view and a perspective view showing a downward suction box used in the third embodiment, respectively.
Figure 7B:
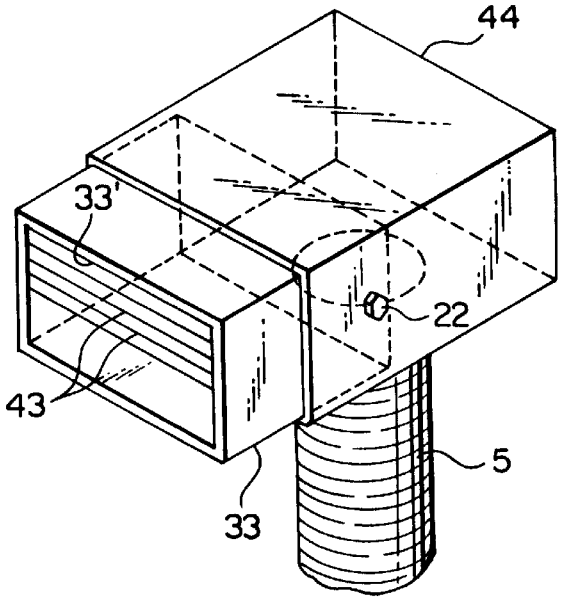
Figure 7C:
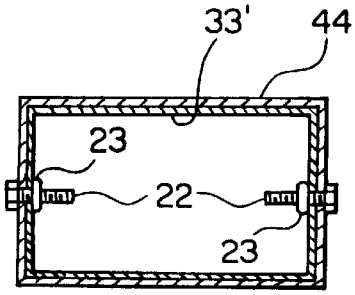
FIG. 7C is a cross-sectional view taken along the line B—B of FIG. 7A.
Figure 8:
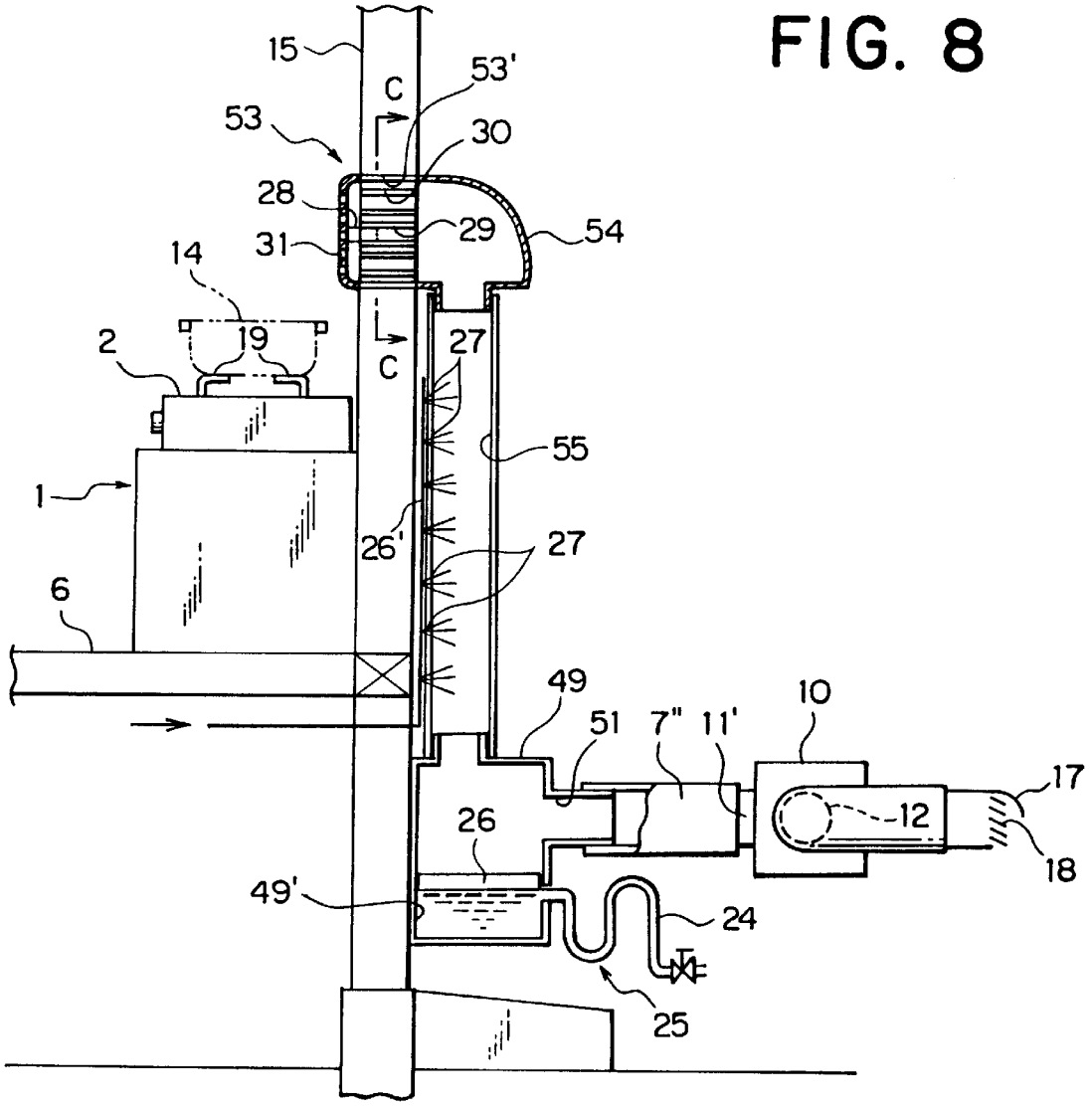
FIG. 8 is a side cross-sectional view showing an exhauster according to a fourth embodiment.

As shown in FIGS. 7A to 7C, horizontally-elongating long holes 23 are formed at both end portions of the suction port 33. By inserting the suction port 33 into the downward suction box 44 and piercing bolts 22 from outside the downward suction box 44 through the long holes 23 of the suction port 33, the suction port 33 can be fixed to the downward suction box 44. The relative positions of the suction port 33 and the downward suction box 44 can be adjusted due to the long holes 23.

Figures 9A, 9B:
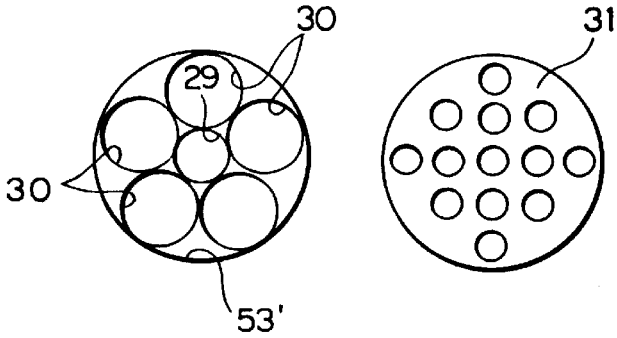
FIG. 9A is a cross-sectional view taken along the line C—C of FIG. 8.
FIG. 9B is a plan view showing a cover used in the fourth embodiment.

Fourth Embodiment:

FIG. B shows an exhauster according to a fourth embodiment. A suction port 53 is disposed inside the partition wall 15. The suction port 53 has a round-shaped opening 53' formed on the surface of the partition wall 15. As shown in FIG. 9A, the opening 53' accommodates a pipe 29 located in the center thereof and a plurality of pipes 30 located around the pipe 29. The front surface of the opening 53' is covered with a cover member 31 having a large number of holes as shown in FIG. 9B. The cover member 31 can be removably attached to the front of the opening 53' by fitting a projection 28 formed in the rear portion thereof into the pipe 29.

At the rear portion of the partition wall 15, a downward pipe 55 is connected to the suction port 53 via a downward suction box 54 with the lower end of the downward pipe 55' being directly connected with an empty box 49. The side surface of the downward pipe 55 is provided with a large number of nozzles 27 so that water can be sprinkled from the nozzles 27 to the inside of the downward pipe 55 via a watering pipe 26'.

A water vessel 49' is formed at the bottom of the empty box 49. A constant amount of water can always be stored in the water vessel 49' by a water level maintenance device 25 using an S pipe 24. An oil-absorbent sheet 26 is floated on the water surface so that the oil floating down the downward pipe 55 can be absorbed and collected by the sheet 26.

Since the suction port 53 has only about half a diameter with respect to the width of the gas range 2 and is divided by the plurality of the pipes 29 and 30, the air can be divided and drawn from the opening 53' neatly without generating a vortex. Therefore, the suction resistance can be small so that suctioning of cooking smoke can be facilitated. If edible oil in the pot 14 on the gas range 2 catches fire, the flame is drawn into the suction port 53 from the holes of the cover member 31 and the combustion heat is transmitted to the cover member 31 and the pipes 29, 30 to lower the temperature thereof and extinguish the fire.

In the above-mentioned embodiments, it is preferable that the heat conductive plates 13 and 43, the pipes 29 and 30, the cover member 31, the downward suction boxes 4, 44 and 54, the downward pipes 5 and 55, the empty boxes 9, 39, and 49, and the pipes 7, 7', 7" are made of stainless steel plate. However, the cover member 31 used in the fourth embodiment may be made of steel.

What is claimed is:

1. An exhauster to be employed with a gas range located on a cooking table, said exhauster comprising:

a suction port to be located at a rear of the gas range, said suction port having a round opening;

a plurality of pipes located within said suction port;

a vertical pipe having a first end connected to said suction port and extending downwardly therefrom;

an empty box connected to a second end of said vertical pipe, said empty box having a cross-sectional area larger than that of said vertical pipe; and a fan connected to said empty box, said fan having an exhaust port to communicate with the outdoors.

2. An exhauster as claimed in claim 1, wherein said fan comprises a sirocco fan.

3. An exhauster as claimed in claim 1, wherein said suction port has a width to be smaller than a width of the gas range.

4. An exhauster as claimed in claim 1, further comprising a downward suction box connected between said suction port and said vertical pipe.

5. An exhauster as claimed in claim 4, wherein the position of said suction port is adjustable relative to said downward suction pipe.

6. An exhauster as claimed in claim 1, further comprising a curved tube connected between said vertical pipe and said empty box.

7. An exhauster as claimed in claim 1, further comprising a pipe having a first end connected to said exhaust port of said fan and a second end to open to the outdoors.

8. An exhauster as claimed in claim 1, further comprising a heat conductive porous plate removably attached to a front surface of said suction port.

9. An exhauster as claimed in claim 1, further comprising a water vessel formed at a bottom of said empty box, and an oil absorbent sheet to be floated on a surface of water to be contained in said water vessel.

10. An exhauster as claimed in claim 9, further comprising a water level maintenance device connected to said water vessel to maintain a level of water therein.

11. An exhauster as claimed in claim 10, further comprising a plurality of nozzles on a side surface of said vertical pipe to sprinkle water therefrom inwardly of said vertical pipe.

12. An exhauster connected to a gas range located on a cooking table, said exhauster comprising:

a suction port located at a rear of said gas range, said suction port having a round opening;

a plurality of pipes located within said suction port;

a vertical pipe having a first end connected to said suction port and extending downwardly therefrom;

an empty box connected to a second end of said vertical pipe, said empty box having a cross-sectional area larger than that of said vertical pipe; and a fan connected to said empty box, said fan having an exhaust port to communicate with the outdoors.

13. An exhauster as claimed in claim 12, wherein said fan comprises a sirocco fan.

14. An exhauster as claimed in claim 12, wherein said suction port has a width smaller than a width of said gas range.

15. An exhauster as claimed in claim 12, further comprising a downward suction box connected between said suction port and said vertical pipe.

16. An exhauster as claimed in claim 15, wherein the position of said suction port is adjustable relative to said downward suction pipe.

17. An exhauster as claimed in claim 12, further comprising a curved tube connected between said vertical pipe and said empty box.

18. An exhauster as claimed in claim 12, further comprising a pipe having a first end connected to said exhaust port of said fan and a second end to open to the outdoors.

19. An exhauster as claimed in claim 12, further comprising a heat conductive porous plate removably attached to a front surface of said suction port.

20. An exhauster as claimed in claim 12, further comprising a water vessel formed at a bottom of said empty box, and an oil absorbent sheet to be floated on a surface of water to be contained in said water vessel.

21. An exhauster as claimed in claim 20, further comprising a water level maintenance device connected to said water vessel to maintain a level of water therein.

22. An exhauster as claimed in claim 21, further comprising a plurality of nozzles on a side surface of said vertical pipe to sprinkle water therefrom inwardly of said vertical pipe.

23. An exhauster as claimed in claim 12, wherein said suction port is disposed on a partition wall of a kitchen within which said gas range is positioned.

24. An exhauster as claimed in claim 12, wherein said suction port is disposed on a wall of a counter.

25. An exhauster to be employed with a gas range located on a cooking table, said exhauster comprising:

a suction port to be located at a rear of the gas range;

a vertical pipe having a first end connected to said suction port and extending downwardly therefrom;

an empty box connected to a second end of said vertical pipe, said empty box having a cross-sectional area larger than that of said vertical pipe;

a water vessel formed at a bottom of said empty box, and an oil absorbent sheet to be floated on a surface of water to be contained in said water vessel; and a fan connected to said empty box, said fan having an exhaust port to communicate with the outdoors.

26. An exhauster as claimed in claim 25, wherein said fan comprises a sirocco fan.

27. An exhauster as claimed in claim 25, wherein said suction port has a width to be smaller than a width of the gas range.

28. An exhauster as claimed in claim 25, further comprising a downward suction box connected between said suction port and said vertical pipe.

29. An exhauster as claimed in claim 28, wherein the position of said suction port is adjustable relative to said downward suction pipe.

30. An exhauster as claimed in claim 25, further comprising a curved tube connected between said vertical pipe and said empty box.

31. An exhauster as claimed in claim 25, further comprising a pipe having a first end connected to said exhaust port of said fan and a second end to open to the outdoors.

32. An exhauster as claimed in claim 25, further comprising a heat conductive porous plate removably attached to a front surface of said suction port.

33. An exhauster as claimed in claim 25, further comprising a water level maintenance device connected to said water vessel to maintain a level of water therein.

34. An exhauster as claimed in claim 33, further comprising a plurality of nozzles on a side surface of said vertical pipe to sprinkle water therefrom inwardly of said vertical pipe.

35. An exhauster as claimed in claim 25, wherein said suction port has a rectangular opening.

36. An exhauster as claimed in claim 25, wherein said suction port has a round opening.

37. An exhauster connected to a gas range located on a cooking table, said exhauster comprising:

a suction port located at a rear of said gas range;

a vertical pipe having a first end connected to said suction port and extending downwardly therefrom;

an empty box connected to a second end of said vertical pipe, said empty box having a cross-sectional area larger than that of said vertical pipe;

a water vessel formed at a bottom of said empty box, and an oil absorbent sheet to be floated on a surface of water to be contained in said water vessel; and a fan connected to said empty box, said fan having an exhaust port to communicate with the outdoors.

38. An exhauster as claimed in claim 37, wherein said fan comprises a sirocco fan.

39. An exhauster as claimed in claim 37, wherein said suction port has a width smaller than a width of said gas range.

40. An exhauster as claimed in claim 37, further comprising a downward suction box connected between said suction port and said vertical pipe.

41. An exhauster as claimed in claim 40, wherein the position of said suction port is adjustable relative to said downward suction pipe.

42. An exhauster as claimed in claim 37, further comprising a curved tube connected between said vertical pipe and said empty box.

43. An exhauster as claimed in claim 37, further comprising a pipe having a first end connected to said exhaust port of said fan and a second end to open to the outdoors.

44. An exhauster as claimed in claim 37, further comprising a heat conductive porous plate removably attached to a front surface of said suction port.

45. An exhauster as claimed in claim 37, further comprising a water level maintenance device connected to said water vessel to maintain a level of water therein.

46. An exhauster as claimed in claim 45, further comprising a plurality of nozzles on a side surface of said vertical pipe to sprinkle water therefrom inwardly of said vertical pipe.

47. An exhauster as claimed in claim 37, wherein said suction port is disposed on a partition wall of a kitchen within which said gas range is positioned.

48. An exhauster as claimed in claim 37, wherein said suction port is disposed on a wall of a counter.

49. An exhauster as claimed in claim 37, wherein said suction port has a rectangular opening.

50. An exhauster as claimed in claim 37, wherein said suction port has a round opening.

* * * * *